United States Patent [19]

Fleming

[11] 4,162,664

[45] Jul. 31, 1979

[54] INTERNAL COMBUSTION ENGINE AND FUEL INTRODUCING MEANS THEREFOR

[76] Inventor: Maurice C. Fleming, 1013 23rd St. W., Bradenton, Fla. 33505

[21] Appl. No.: 832,639

[22] Filed: Sep. 12, 1977

Related U.S. Application Data

[63] Continuation-in-part of Ser. No. 583,980, Jun. 5, 1975, abandoned.

[51] Int. Cl.[2] ..... F02B 75/04; F02B 3/00

[52] U.S. Cl. ..... 123/75 B; 123/32 C; 123/32 D; 123/32 G; 123/33 B; 123/191 SP

[58] Field of Search ..... 123/32 L, 32 D, 32 G, 123/32 K, 32 L, 32 SP, 32 ST, 33 B, 33 C, 33 D, 33 F, 33 G, 78 B, 191 S, 191 SP, 143 B, 59 BR, 139 AJ

[56] References Cited

U.S. PATENT DOCUMENTS

| | | | |
|---|---|---|---|
| 887,703 | 5/1908 | Sharpneck | 123/75 B |
| 1,302,653 | 5/1919 | Goodspeed | 123/32 G |
| 1,305,533 | 6/1919 | Gerhardt | 123/33 B |
| 1,345,723 | 7/1920 | Williams | 123/37 B |
| 1,505,100 | 8/1924 | Lightfoot | 123/32 D |
| 1,525,776 | 2/1925 | French | 123/32 D |
| 2,126,442 | 8/1938 | Band | 123/33 B |
| 2,146,032 | 2/1939 | Scott | 123/33 B |

FOREIGN PATENT DOCUMENTS

| | | | |
|---|---|---|---|
| 282129 | 10/1912 | Fed. Rep. of Germany | 123/32 D |
| 807254 | 1/1937 | France | 123/32 SP |
| 222825 | 2/1925 | United Kingdom | 123/32 G |

*Primary Examiner*—Charles J. Myhre
*Assistant Examiner*—David D. Reynolds
*Attorney, Agent, or Firm*—Frederick Shapoe

[57] ABSTRACT

An internal combustion engine having a precombustion chamber connected to the cylinder by a venturi passage is supplied fuel through an opening in the venturi passage. Fuel is supplied to the precombustion chamber in an initial increment on the compression stroke so that the air and fuel in the precombustion chamber can be ignited at the end of the compression stroke and a stream of high pressure, hot gases returning through the venturi aspirate a second increment of fuel for completing combustion of the air in the cylinder. A bypass conduit from the precombustion chamber conveys gas under pressure to the fuel near the opening in the venturi to assist in ejecting said second increment of fuel into the hot gases in the venturi. A small cylinder and piston, or a diaphragm in the bypass conduit transmit pressure to the fuel without letting hot gases contact the fuel.

In a modification employing a valved opening, a fuel-air mixture is introduced into the precombustion chamber during the intake stroke of the piston. Upon combustion of this mixture in the precombustion chamber, an increment of liquid fuel is ejected at the venturi into the stream of hot, high pressure gases flowing from the precombustion chamber into the cylinder to provide fuel for the air in the cylinder.

11 Claims, 4 Drawing Figures

INTERNAL COMBUSTION ENGINE AND FUEL INTRODUCING MEANS THEREFOR

RELATED APPLICATION

This application is a continuation-in-part of my copending patent application Ser. No. 583,980, now abandoned filed June 5, 1975 which is entitled "Fuel Injection System."

BRIEF DESCRIPTION OF THE PRIOR ART

In most fuel injection systems, liquid fuel is pumped from a fuel tank to pressurizing and metering means and is then conveyed to atomizing nozzles for injection into the cylinder at about top dead center of the piston stroke during compression. Such injection systems are complex in structure and require highly precise parts which increases both the initial cost and subsequent maintenance thereof.

While precombustion chambers in internal combustion engines are known, as shown in U.S. patents to French 1,594,774, Lightfoot 1,505,100, Saives 1,607,173 and Trachella 1,753,253, none employ means for introducing the fuel into the compressed air stream as it passes through a venturi passage into the precombustion chamber in a manner to produce a stratified charge, nor does any patent teach the introduction of an added increment of fuel into the hot gas stream after combustion is initiated in the precombustion chamber in order to enable more complete combustion with the air in the cylinder. No patent teaches the bypassing of a portion of the hot gases from the precombustion chamber to the fuel introducing means in order to apply pressure to the fuel to inject it into the stream in the venturi passage.

SUMMARY OF THE INVENTION

The present invention provide a simple and novel fuel introducing means for an internal combustion engine having a cylinder and a piston therein with a precombustion chamber connected to the cylinder by a venturi passage. A fuel introducing means comprising a fuel chamber is located adjacent the venturi passage and is connected to it by an opening at the throat of the venturi. A valved line connects the fuel chamber to a fuel reservoir and is under moderate pressure so as to force fuel into the fuel chamber. In some instances the fuel line immediately adjacent to the venturi throat opening may serve as the fuel chamber. A bypass conduit is connected to the main portion of the precombustion chamber and is joined to the fuel chamber at a point spaced from the opening. When the piston during the compression stroke compresses air in the cylinder, some of the air is forced through the venturi passage into the precombustion chamber and creates a reduced pressure at the opening such that liquid fuel near the opening is drawn into the air stream and admixed with it. At the top of the piston's compression stroke, a spark plug or other suitable ignition device in the precombustion chamber ignites the combustible air-fuel mixture compressed therein, combustion takes place and a high pressure develops as a result. This causes a stream of hot combusting gases to be driven through the throat of the venturi passage into the cylinder. A reduced pressure is effective at the opening leading to the fuel chamber which assists in aspirating an added increment of fuel into the stream of hot gases whereby the added increment of fuel is not only thoroughly admixed, but vaporized so that when it meets the air in the cylinder just above the piston head it will continue the combustion process. If the injector is designed for continuous fuel flow from the fuel reservoir, after fuel injection through the venturi is completed, high gas pressures in the precombustion chamber and engine cylinder blocks further fuel flow during the power cycle. Fuel flowing during exhaust and intake cycles will mix during the intake cycle with the air drawn into the engine cylinder during this cycle. As a result, this fuel will have a more complete and efficient combustion in the nature of stratified combustion.

In order to secure an accurately metered and more forceful ejection of the fuel from the opening at the venturi passage during the flow of the stream of combusting gases therethrough, there is provided in the bypass conduit a pressure transmitting means such as a free floating piston in a small cylinder, normally biased by a spring to oppose the gases flowing in the bypass conduit. The high gas pressure developed and effective in the conduit causes the piston to make a predetermined small movement against the spring and exert a forceful push on the fuel immediately back of the piston and this push ejects a precise increment of fuel through the opening at the time that there is a strong aspirating effect at the opening. The piston also serves to prevent any possibility of the hot gases in the bypass conduit contacting any fuel and causing excess heat transfer to the fuel area resulting in vapor lock or a fire. A diaphragm can be employed instead of a piston in the bypass conduit.

In a modified form of the invention, the fuel necessary to cause the air charge in the precombustion chamber to become combustible can be partly or entirely added by a regular carburetor by employing a valve in the precombustion chamber to admit air plus gasoline, for example, during the intake stroke of the piston. The valve closes during compression and air passes through the venturi picking up more fuel at the opening therein, and ignition of the charge in the precombustion chamber causes a hot stream of high pressure gas to be forced out of the precombustion chamber. A part of this high pressure combusted gas is carried by the bypass conduit to the small piston where it forcibly ejects a stream of fuel into the hot gas stream flowing through the venturi.

DETAILED DESCRIPTION OF THE INVENTION

Figure 1:
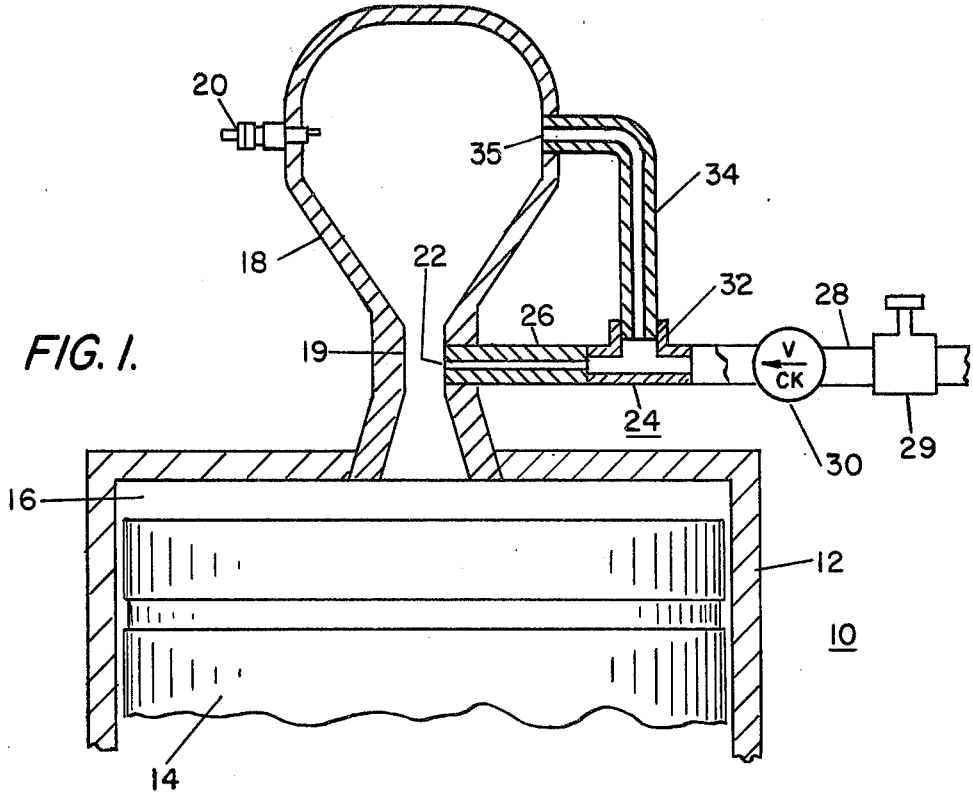
FIG. 1 is a schematic view, partly in cross section, of an internal combustion engine, embodying the invention.

Referring to FIG. 1 of the drawing, an internal combustion engine 10 comprising a cylinder 12 in which a reciprocating piston 14 is disposed for movement has a space 16 between the cylinder head and the piston which is connected to a precombustion chamber 18 by a venturi passage 19. A spark plug 20 is located in the precombustion chamber 18 to ignite gas-fuel mixtures therein near the top position of piston 14 in the cylinder 12. At the narrowest portion or throat of the venturi passage 19 is located an opening 22 connected to a fuel chamber 24 which has a line 26 supplying liquid fuel to the opening 22. Liquid fuel from a suitable fuel reservoir where it is under a moderate pressure of for example, 5 to 15 psi, is conveyed by a fuel line 28 provided with a check valve 30, to the fuel chamber 24. A throttle or needle valve 29 is present in line 28 to control the flow of the fuel. A tee connection 32 in the chamber 24 is joined to one end of a small bore bypass conduit 34 whose upper end passes through the wall of the precombustion chamber 18 and has an opening 35 to admit gases thereto.

The volume of the precombustion chamber 18 is from about 10% to 35% of the total volume of the space in which air is present when the piston 14 is at top dead center. A major proportion, namely from 65% to 90% of the air is present in the volume between the cylinder head of cylinder 12 and the top face of the piston 14.

For operation as a four cycle engine, the piston 14 draws in air through an intake valve (not shown) on the intake stroke, then with the intake valve closed, the piston compresses the air and a stream of compressed air flows through the venturi 19 into the precombustion chamber 18. As the air flows by the opening 22 in the venturi passage 19 it creates a reduced pressure at the opening 22 which causes an increment of fuel in line 26 near the opening to be aspirated into the stream of air passing by and being thoroughly mixed with that air so as to form a combustible fuel-air mixture. At the top dead center of the compression stroke, or a little before this position, an electrical current is passed to the spark plug 20 to ignite the fuel-air mixture in the precombustion chamber. Combustion of the fuel-air mixture causes a rapid build-up of pressure in the precombustion chamber and a high velocity stream of hot combusting gases is driven through the venturi 19 where it applies an aspirating effect at opening 22. At the same time the high pressure gases pass through the opening 35 into the bypass conduit 34 and compress any air or combustion gas mixture in the conduit, applying a pressure to the liquid fuel in chamber 24. It will be noted that this pressure is applied at a point in chamber 24 spaced from the opening 22 so that a quantity of liquid fuel is disposed between it and the opening. The check valve 30 prevents fuel from being driven back into the fuel line 28. Consequently the pressure from conduit 34 causes a second and larger increment of liquid fuel to be forcibly ejected from fuel chamber 34 through opening 22 into the high velocity hot gas stream passing through the venturi 19. This results in a thorough admixture and vaporization of the ejected fuel increment with these gases and as this hot fuel-gas mixture reaches the space 16 within cylinder 12 it combusts with the compressed air therein. Any fuel mixed with the engine air which has resulted from a continuous fuel flow design will have a more complete and efficient combustion in the nature of stratified combustion. This combustion applies pressure to the piston 14 which is driven down in its power stroke.

At the completion of the power stroke, an exhaust valve (not shown) opens and the combusted gases are vented. The pressure in the precombustion chamber falls and gases in the bypass conduit flow back through opening 35, leaving cool gas in the conduit. The flow of fuel from the fuel line 28 resumes and a metered trickle of fuel refills the fuel chamber 24 during the exhaust and air intake stroke of the piston so that enough liquid fuel enters the chamber 24 to ensure an increment of liquid fuel being present at the opening 22 at the time that the compression stroke begins.

A modification will include a timed valve in place of valve 29 so as to provide for intermittent flow of fuel to fuel chamber 24 and opening 22. This adds flexibility in the amount and time of the fuel ejected. For example, proportionately greater amounts can be moved to fuel chamber 24 during the latter part of the compression stroke in order to provide for additional engine load while still providing a combustible mixture for precombustion chamber 18 through a lower fuel movement earlier.

A further modification would provide for the use of gaseous fuels delivered to fuel chamber 24.

An engine of two inch bore and a two inch stroke was provided with a precombustion chamber having a volume equal to about 15% of the total volume of gases at top dead center during the compression stroke. The engine was supplied gasoline using the fuel system shown in FIG. 1. The engine ran smoothly and efficiently, without any injectors or carburetor, using the apparatus as shown. The speed was readily controlled by appropriately opening or closing a needle valve 29 in fuel line 28.

While only a single piston and cylinder are shown, an engine with a plurality of pistons and cylinders, each arranged as shown can be employed. A single fuel metering means may be employed for more than one fuel chamber. The fuel introducing means is simple, efficient and requires a minimum of care and maintenance.

Figure 2:
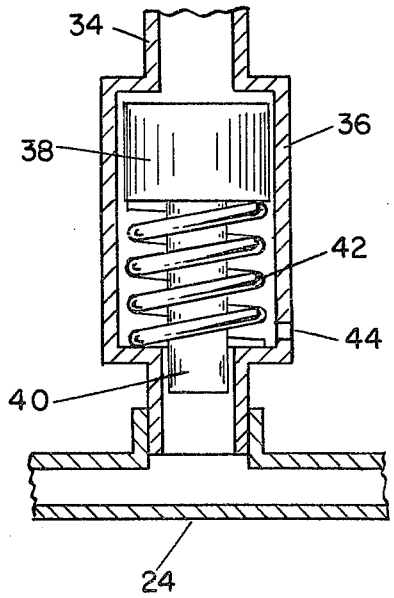
FIG. 2 is a fragmentary cross-section of the small cylinder and piston in the bypass conduit.

It is desirable in some cases to provide in bypass conduit 34 a small cylinder and piston as shown in FIG. 2 of the drawing in order to apply a higher pressure to the liquid fuel to cause it to be ejected more forcefully into the hot combusting gases flowing through venturi passage 19. The bypass conduit is provided with an enlarged cylinder portion 36 in which a free floating piston 38 can move within small predetermined limits of travel. The lower end of the small piston 38 is provided with a smaller diameter plunger 40 so that the pressure it applies to the liquid fuel in chamber 24 is greater than the gas pressure in bypass conduit 34. A spring 42 moves the piston 38 upwardly when the gas pressure in conduit 34 is reduced substantially. An aperture 44 in the lower end of cylinder 36 permits air to be vented as the piston 38 is forced downwardly. The piston 38 also serves to prevent any possibility of a flame from the precombustion chamber entering the fuel chamber 24. Normally there is always a volume of relatively cool gas in conduit 34 which is in contact with the fuel proper. While the free floating piston 38 is larger than the plunger 40, in some cases it can be of the same or smaller diameter. It also serves to prevent an excess of hot gas from entering the chamber 24 and causing vapor lock to occur. Fuel ejected into venturi 19 may be metered by controlling the movement of piston 38.

Figure 3:
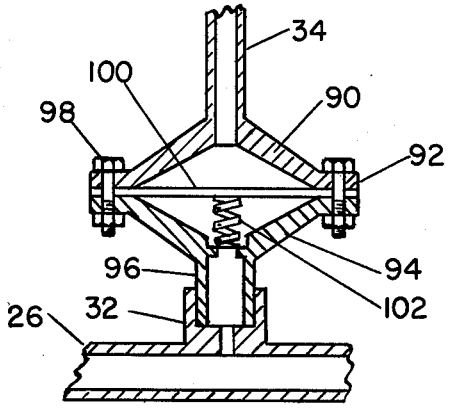
FIG. 3 is a fragmentary cross-section through the bypass conduit showing a diaphragm therein.

Referring to FIG. 3, there is shown a modified form of the arrangement of FIG. 2, using a diaphragm in place of a piston. The bypass conduit 34 terminates in a cone-shaped end 90 with a flange 92 which faces a mating upside down cone-shaped terminal 94 on a tube 96 which is joined to tee 32 of chamber 24. Machine bolts fasten the flanges 92 between which is placed a diaphragm 100 which is normally biased upwardly by a spring 102 resting on an abutment or the like, in tube 96. Fuel in tube 96 contacts the lower face of the diaphragm 100, so that when the high pressure in conduit 34 due to combustion in precombustion chamber 18 impinges on the upper face of diaphragm 100 it will drive a measured increment of the fuel below the diaphragm 100 into chamber 24 and causes it to be ejected from the line 26 through opening 22 into the high velocity hot gas stream in venturi 19.

Figure 4:
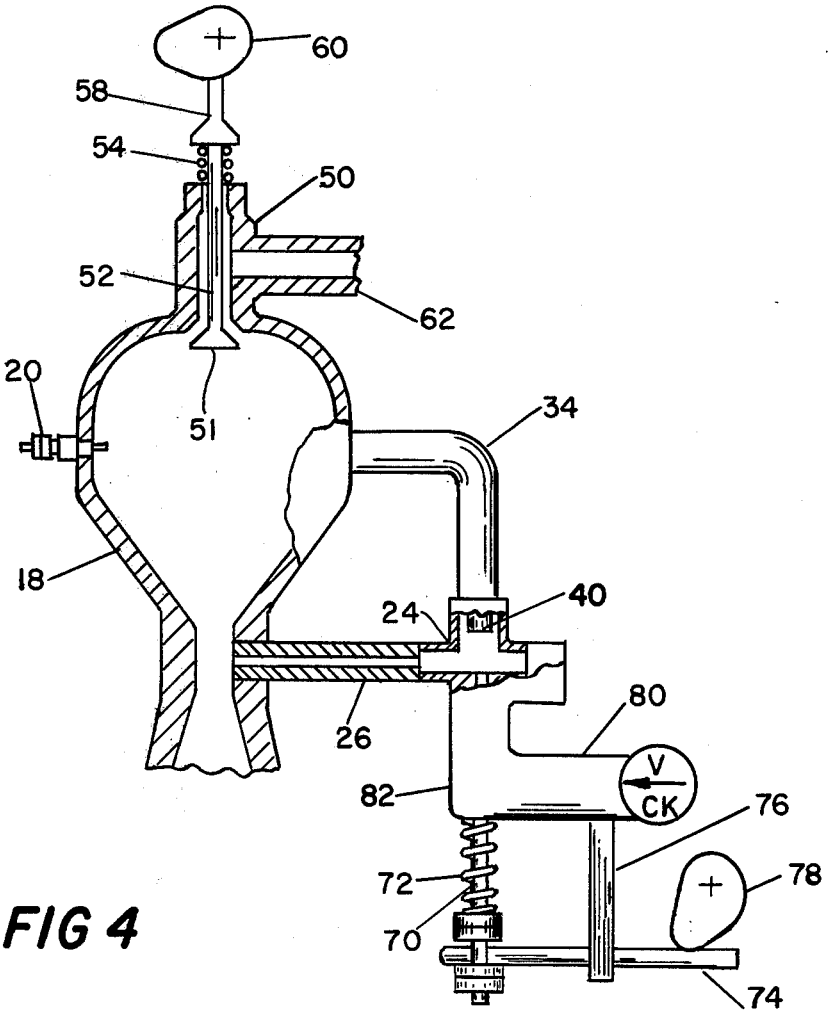
FIG. 4 is a schematic view of a modified form of the invention, partly in cross-section.

Referring to FIG. 4, there is shown a modified form of the fuel supplying means which is useful for supplying a low volatility fuel such as diesel fuel, along with a small amount of gasoline or kerosine to a low compression engine. To the precombustion chamber 18 is affixed a hollow extension 50 in which a valve 51 reciprocates under the movement of valve stem 52 which is biased upwardly by a compression spring 54 disposed between an enlarged tappet 58 and the upper end 56 of the extension 50. A cam 60 is operatively connected to the engine drive shaft so that it forces the tappet 58 down during the intake or suction stroke of the piston 14, so as to move valve 51 to its open position, but the valve 51 is otherwise in closed position. An inlet 62 in the side wall of the extension 50 connected to a carburetor or to a fuel gas line which supplies a fuel-air mixture, for instance gasoline or kerosine and air, when the valve 51 is open. Also, propane or other combustible gas, alone or admixed with air can be so introduced. The amount of fuel plus air admitted through valve 51 is just sufficient to fill the precombustion chamber 18 with a combustible mixture, the regular intake valve of the engine filling the cylinder above the piston with air. A slight excess of either air alone or of fuel-air mixture is not critical.

The fuel chamber 24 in the FIG. 4 modification is supplied with a less expensive, lower volatility fuel such as light diesel oil or the like that is usually employed in high compression engines with a precision injector. During the compression stroke only a small increment of diesel fuel oil is aspirated by the air passing opening 22 in the venturi 19, but the fuel-air mixture present in the precombustion chamber 18 after being admitted by valve 51, is an explosive mixture and at about the top of the compression stroke of piston 14, the spark plug 20 is energized to ignite the fuel-air mixture in chamber 18 which burns explosively and a high pressure develops. A stream of hot, burning gases streams through the venturi 19 to reduce, by an aspirating effect, the pressure at opening 22, and concurrently high pressure gases enter bypass conduit 34 which acts on either a piston 38 or a diaphragm 100 in the fuel chamber 24 to cause the ejection of a larger increment of diesel fuel into the stream of hot, high pressure gases at opening 22 wherewith the diesel fuel is vaporized and admixed thoroughly. This diesel fuel enters the space above piston 14 where it burns with the air there present and completes the combustion process. Thus an engine that operates at relatively moderate compression ratio of from 6 to 8 or 10 can be made to operate with diesel fuel oil as the main source of fuel, using only a fraction of the otherwise needed quantity of gasoline in the precombustion chamber. Of course gasoline or kerosine can be used in fuel chamber 24 in FIG. 4 if desired.

When the combustion stroke is completed, the pressure drops in chamber 24, and fuel is replenished therein by the use of a diaphragm pump or other similar means in fuel line 80 from a supply tank.

FIG. 4 also shows an arrangement for timed fuel ejection into venturi 19. Casing 82 includes fuel chamber 24 which is connected to line 26 connected to bypass conduit 34. In casing 82 is a valve operable by a plunger 70 for timed flow of fuel into fuel chamber 24. Valve plunger 70 is biased downwardly by spring 72 and is movable upwardly by a lever arm 74 operated by a cam 78 operatively connected to the drive shaft of the engine to open valve operated by the plunger 70 and provides for variations in the time and amount of fuel delivery, according to design requirements during the power, exhaust, intake and compression strokes. Casing 82 may also include an injector valve similar to well-known fuel injector valves which release fuel from increased fuel pressure to a fuel line for nozzle injection. This valve lies horizontally in casing 82 and opens to line 26. When fuel pressure builds up in fuel chamber 24 from the movement of piston 14 and with valve plunger 70 in closed position, this ejector valve would be forced back and off its seat, permitting fuel to flow forcibly through line 26.

I claim:

1. In an internal combustion engine having a cylinder and a piston within the cylinder movable during a compression stroke to compress air in an upper portion of the cylinder, and the piston being driven down during a power stroke when the compressed air admixed fuel is ignited and is combusted, the improvement in means for fuel introduction and combustion thereof comprising:

(a) an enlarged precombustion chamber connected by a venturi passage to the upper portion of the cylinder so that during the compression stroke a part of the compressed air is forced through the venturi passage into the precombustion chamber, the precombustion chamber having an ignition means, (b) a combustible fuel introducing means having a fuel chamber connected by a small opening to the venturi passage, valved means for conveying fuel to the fuel chamber from a fuel reservoir, said valved means disposing an increment of fuel from the fuel chamber to said opening when the gas pressure in the precombustion chamber is low so that on the compression stroke compressed air flowing through the venturi passage will induce a reduced pressure at the opening whereby to draw the increment of fuel into the venturi passage and cause it to be admixed with the passing air stream so as to provide a combustible air-fuel mixture in the precombustion chamber, and (c) a by-pass conduit for conveying gases from the precombustion chamber to the fuel introducing means, a pressure transmitting means in the by-pass conduit to apply pressure from the gases therein to the fuel in said fuel chamber at a point spaced from the opening in the venturi passage, whereby when the ignition means ignites the combustible mixture in the precombustion chamber and causes combustion and a high gas pressure develops, a high velocity hot gas stream flows through the venturi passage into the upper portion of the cylinder thereby inducing a reduced pressure on another increment of fuel at said opening and concurrently gases under high pressure pass through the by-pass conduit to the pressure transmitting means so as to apply pressure to and thereby forcibly eject an increment of fuel through the opening into the high velocity hot gas stream in the venturi passage for thorough admixture therewith and to provide for ignition and a more complete and efficient combustion with the air in the upper portion of the cylinder, and thereby completing the power stroke of the piston.

2. The means for fuel introduction of claim 1, wherein a spring biased diaphragm comprises the pressure transmitting means.

3. The internal combustion engine of claim 1, wherein the pressure transmitting means comprises a small cylinder connected at one end to the by-pass conduit and at the other end to the fuel chamber, a floating piston in the cylinder with one face receiving gas pressure from the by-pass conduit, spring biasing means tending to move the piston against such gas pressure, and another face of the piston being in contact with the fuel in the fuel chamber.

4. The means for fuel introduction of claim 3, wherein the piston in said small cylinder has a larger area exposed to the gas flow in the by-pass conduit than the area of the face in contact with the fuel, thereby increasing the pressure on the fuel.

5. The means for fuel introduction of claim 3, wherein the piston in said small cylinder is restricted in its travel by suitable stop means whereby the volume of fuel forced out from the chamber is controlled.

6. In an internal combustion engine having a cylinder and a piston within the cylinder movable during the compression stroke to compress air in an upper portion of the cylinder, the piston being driven down during the power stroke thereof when the compressed air admixed with a fuel is ignited and combusts, the improvement in means for fuel introduction and combustion thereof comprising:

(a) a precombustion chamber connected by a venturi passage to the upper portion of the cylinder so that during the compression stroke a part of the compressed air is forced through the venturi passage into the precombustion chamber, and an ignition means in the precombustion chamber, (b) combustible fluid fuel introducing means having a fuel chamber connected by a small opening to the venturi passage, valved means for conveying fluid fuel to the fuel chamber from a fuel reservoir, said last mentioned means including a check valve preventing backward flow of the fuel, said valved means disposing an increment of fuel from the fuel chamber in said opening at a time when gas pressure in the precombustion chamber is low so that during the compression stroke the flow of compressed air in the venturi passage will induce a lowered pressure at the opening whereby to draw the the increment of fuel into the air stream in the venturi passage and cause it to be admixed with the passing air to provide a combustible air-fuel mixture in the precombustion chamber, and (c) a narrow bore by-pass conduit for conveying gases from the precombustion chamber to the fuel chamber to apply a gas pressure to the fluid fuel at a point spaced from the opening in order to cause the ejection of a second increment of fuel after combustion takes place in the precombustion chamber and results in a high pressure hot gas stream to flow through the venturi passage into the cylinder of the engine and such hot gas stream is admixed thoroughly with the ejected second increment of fuel whereby to provide additional fuel for combustion with the air in the cylinder, so as to enable more efficient and complete combustion of the air.

7. The means for fuel introduction of claim 6, wherein the precombustion chamber includes a valved means for admitting an air-fuel mixture directly from the exterior during the air intake stroke of the piston in order to fill the precombustion chamber with a combustible air-fuel mixture before the compression stroke, and the fuel chamber supplies fluid fuel to said opening in the venturi passage primarily during the combustion in the precombustion chamber in an increment to enable the combustion of the air within the cylinder.

8. The internal combustion engine of claim 6, wherein additional means are provided for introducing an initial charge of fuel into the precombustion chamber at a period prior to the power stroke.

9. The internal combustion engine of claim 6, wherein fuel injection means are provided for injecting an increment of fuel into the precombustion chamber at prior to the power stroke.

10. The internal combustion engine of claim 1, wherein the valved means for conveying fuel comprises means for timed intermittent flow of fuel to the fuel chamber at selected portions of the engine cycle.

11. In an internal combustion engine having a cylinder and a piston within the cylinder movable during a compression stroke to compress air within an upper portion of the cylinder, the piston being driven down during the power stroke thereof when the compressed air admixed with a fuel is ignited and combusts, the improvement in means for fuel introduction and combustion thereof comprising:

(a) a precombustion chamber connected by a venturi passage to the upper portion of the cylinder so that during the compression stroke compressed air is forced through the venturi passage into the precombustion chamber, an ignition means in the precombustion chamber, the volume of the precombustion chamber being such that at the top dead center position of the piston on the compression stroke from about 10% to 35% of the gases are present therein and the balance are in the cylinder, (b) combustible fuel introducing means comprising a fuel chamber connected by a line to a small opening in the venturi passage, valve means for conveying fuel to the fuel chamber, said valve means disposing a quantity of fuel in the fuel chamber so that an increment of fuel is present at the opening in the venturi and is drawn into the air stream as compressed air flows during the compression stroke from the cylinder into the precombustion chamber and such increment of fuel is admixed with the passing air to provide a combustible air-fuel mixture in the precombustion chamber, and (c) a narrow bore by-pass conduit for conveying gases from the precombustion chamber to the fuel chamber to apply pressure to the fuel in the fuel chamber at a point spaced from the small opening in order to cause the ejection of a second increment of fuel after combustion takes place in the precombustion chamber and results in a high pressure stream of hot gases flowing through the venturi passage into the cylinder of the engine and such hot gas stream is admixed thoroughly with the ejected second increment of fuel whereby to provide additional fuel for combustion of the air in the cylinder, so as to enable more efficient and combustion utilizing the entire volume of compressed air.

* * * * *